US005199479A

United States Patent [19]

Kraeutler

[11] Patent Number: 5,199,479

[45] Date of Patent: Apr. 6, 1993

[54] SKID FOR A RAISABLE-CURTAIN GOODS-HANDLING DOOR

[75] Inventor: Bernard Kraeutler, Dunieres, France

[73] Assignee: Nergeco (société anonyme), Dunieres, France

[21] Appl. No.: 845,614

[22] Filed: Mar. 4, 1992

[30] Foreign Application Priority Data

Mar. 7, 1991 [FR] France ..... 91 02712

[51] Int. Cl.[5] ..... E06B 9/06

[52] U.S. Cl. ..... 160/84.1; 160/264; 160/271

[58] Field of Search ..... 160/84.1, 133, 201, 160/264, 267.1, 268.1, 273.1, 274, 209, 193, 271, 23.1, 26

[56] References Cited

U.S. PATENT DOCUMENTS 2,750,740 8/1973 Newman ..... 160/264 X
3,292,685 12/1966 Clark ..... 160/264 X
4,665,964 5/1987 Zommers .
4,934,437 6/1990 Kraeutler ..... 160/84.1

FOREIGN PATENT DOCUMENTS 3631919 4/1988 Fed. Rep. of Germany .
60338 2/1970 Luxembourg .
449413 6/1936 United Kingdom ..... 160/264
04079 4/1990 World Int. Prop. O. .

*Primary Examiner*—Blair M. Johnson
*Attorney, Agent, or Firm*—Sughrue, Mion, Zinn, Macpeak & Seas

[57] ABSTRACT

A sliding skid for the end of a reinforcing bar of a curtain of a raisable-curtain industrial door of the type comprising a curtain and a rigid door frame including two vertical lateral uprights disposed on either side of the door, forming or containing slideways, and interconnected at their top ends by a horizontal cross-member, said curtain being capable of being lowered or raised between the uprights to be collected together at the top of the door, and being reinforced by equidistant horizontal reinforcing bars, the edges of the curtain and the ends of the reinforcing bars sliding in the slideways, the bars being disposed in sheaths formed by localized double thicknesses of the curtain, wherein the skid is generally semi-cylindrical in shape, having fixing means for fixing to the curtain, and having a radial finger at one of its ends for being engaged through a slot in the sheath of the curtain to limit displacement of a reinforcing bar whose end may come into abutment against said finger.

3 Claims, 3 Drawing Sheets

FIG. 2
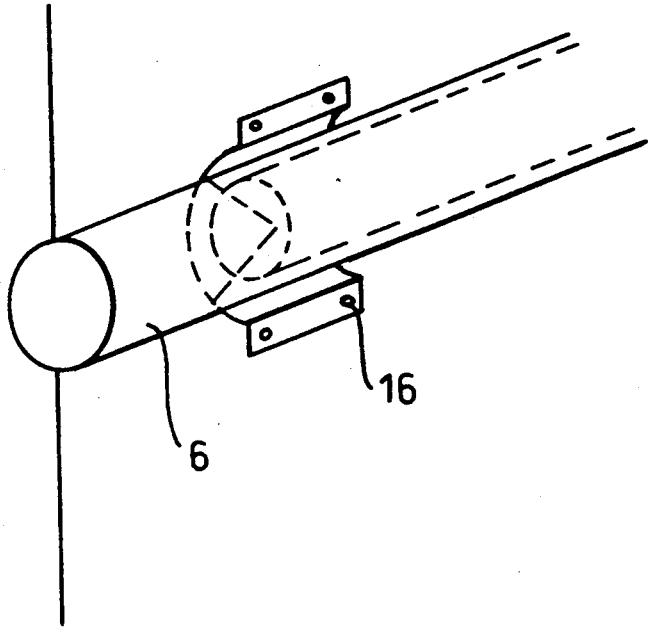
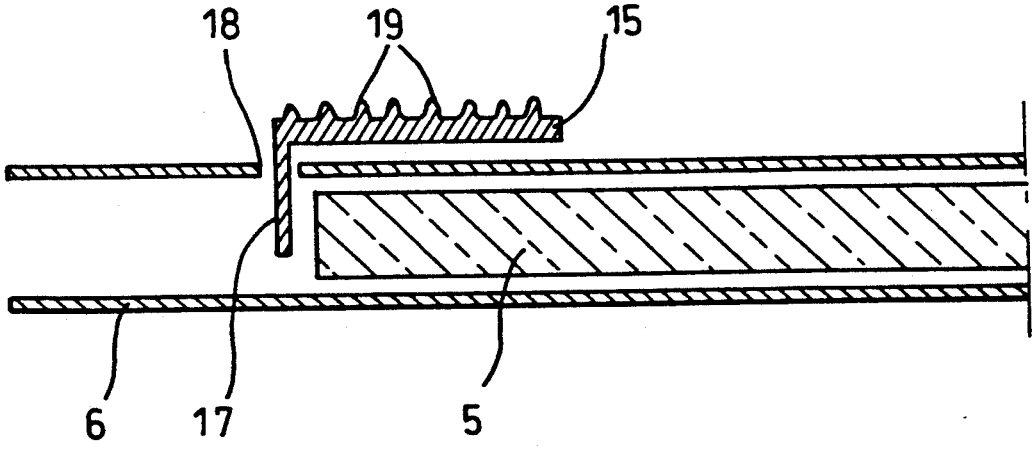
FIG. 3

SKID FOR A RAISABLE-CURTAIN GOODS-HANDLING DOOR

BACKGROUND OF THE INVENTION

The present invention relates to goods-handling doors for factories, warehouses, hangars, stores, etc., of the type generally comprising a curtain and a rigid door frame.

Such doors have two vertical lateral uprights disposed on either side of the door, which uprights form or contain slideways, and are interconnected at their top ends by a horizontal cross-member, the curtain being capable of being lowered or raised between the uprights so as to be collected together at the top of the door, the curtain being reinforced by equidistant horizontal reinforcing bars, the edges of the curtain and the ends of the reinforcing bars sliding in the slideways, and the bars being disposed in sheaths constituted by localized double thicknesses of the curtain.

In order to facilitate the sliding of the ends of the bars in the slideways, and to reduce noise and wear, proposals have already been made to fit the ends of the reinforcing bars with wheels or with skids.

SUMMARY OF THE INVENTION

The present invention provides an improved skid for the end of a reinforcing bar in such a curtain, wherein the skid is generally semi-cylindrical in shape, having means for fixing to the curtain, and carries a radial finger at one of its ends for being engaged inside the sheath of the curtain to limit the displacement of the reinforcing bar whose end may come into abutment against said finger.

The invention also provides door including at least one such skid. This disposition makes it possible for the edge of the curtain to slide properly in the slideway while avoiding tearing of the curtain, and it avoids the bar coming into abutment against and rubbing against the web of the slideway.

Advantageously, the outside surface of the semi-cylindrical portion is provided with ribs extending perpendicularly to the axis of the cylinder.

BRIEF DESCRIPTION OF THE DRAWINGS

An embodiment of the invention is described by way of example with reference to the accompanying drawings, in which:

FIG. 2 is a diagrammatic view on a larger scale showing a detail of FIG. 1;

FIG. 3 is a section view on a horizontal plane showing a detail of FIG. 2; and

DETAILED DESCRIPTION

Figure 1:
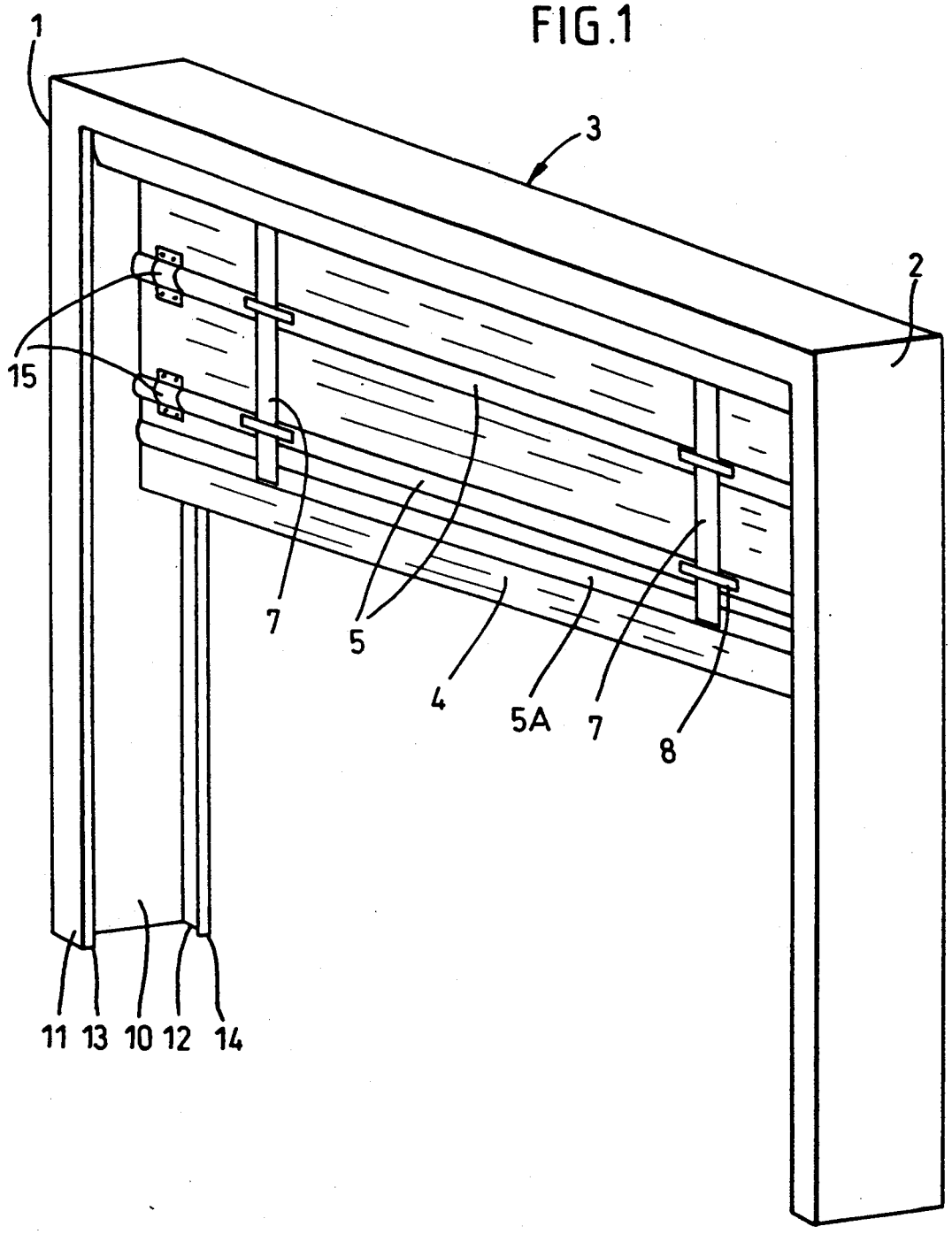
FIG. 1 is a perspective view of an embodiment of a door fitted with skids of the present invention.
Figure 4:
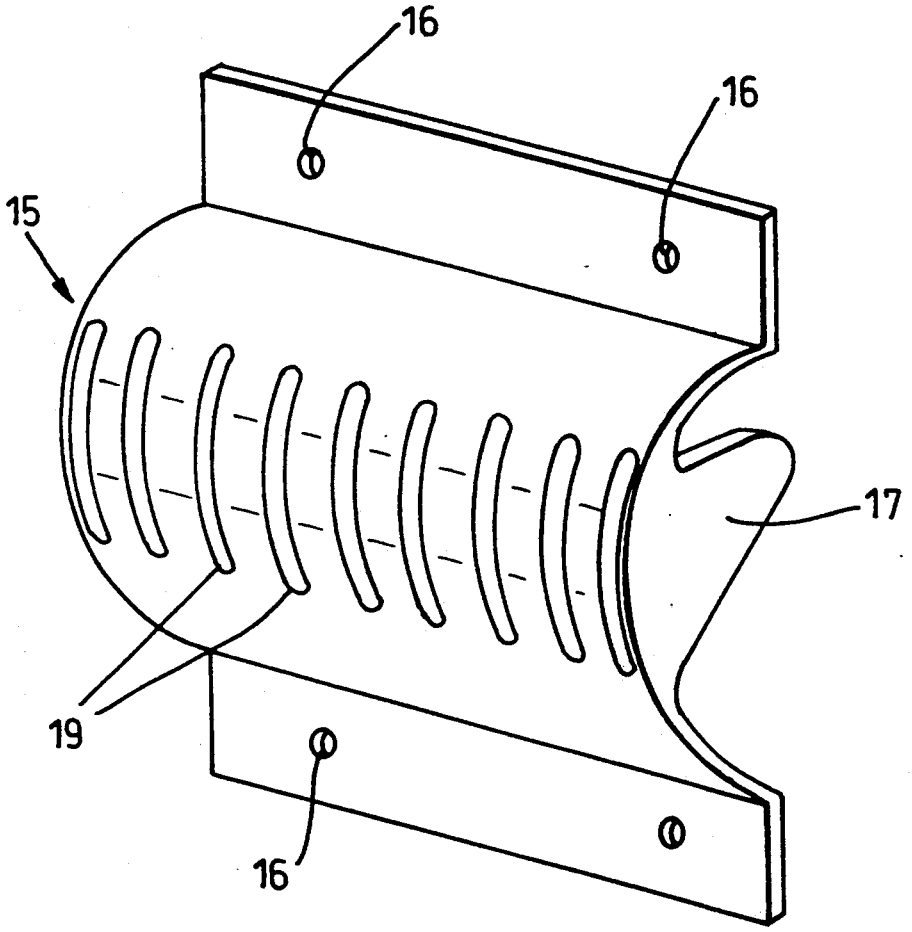
FIG. 4 is a perspective view of one particular embodiment of a skid in accordance with the present invention.

The invention is applicable to all kinds of doors that include a curtain reinforced by horizontal reinforcing bars, with the edges of the curtain and the ends of the bars being guided in vertical lateral slideways. An example of such a door is shown in FIG. 1.

It comprises a door frame made up of two lateral uprights 1 and 2 interconnected at their top ends by a cross-member 3 formed by a downwardly-open channel section beam. The cross-member houses a wind-up shaft, and an electric motor for driving it, together with the usual accessories such as end-of-stroke contact, etc. Examples of actuator members and various accessories for such a door are described in detail in patents EP-0,254,639 and U.S. Pat. No. 4,828,003. The top edge of a curtain 4 is secured to the web of the cross-member 3. The curtain is reinforced by reinforcing bars 5 received in sheaths 6 each constituted by a local double thickness of the curtain. To raise the curtain, straps 7 are fixed to the bottom bar 5A and pass through loops 8 fixed to the other bars. The straps are fixed to the shaft. When the shaft is rotated, the straps wind onto the shaft and raise the curtain which folds concertina-like. In the opposite direction the curtain is lowered. An example of such a curtain suitable for folding concertina-like is disclosed in patent application EP-0 412 857 and in U.S. Pat. No. 5,072,767.

The two edges of the curtain and the corresponding ends of the reinforcing bars are guided in slideways which are constituted in this case by the vertical lateral uprights 1 and 2. Each upright comprises a web 10 and two flanges 11 and 12. The edges of the flanges may be folded with folds 13 and 14 as shown, or they may include other folds, for the purposes of stiffening the slideway, and/or reducing the wear of the curtain against the edges of the slideways. Each fold 13 or 14 may form a plate that is substantially perpendicular to the curtain, or more generally that is not parallel to the curtain.

In an advantageous disposition of the present invention, the length of the bars 5' is shorter than the width of the curtain, while being greater than the spacing between the slideways so as to provide guidance.

In order to protect the edges of the curtain at the sheaths 6, and in order to maintain the bars properly positioned, i.e. to prevent the ends of the bars rubbing against the webs of the slideways, the present invention provides for a skid 15 to be placed against each sheath at the end of the bar when the bar is centered in the proper position, the skid 15 being advantageously semi-cylindrical in shape and being fixed to the curtain, e.g. by rivets placed in holes 16 provided through the skid above and below the sheath. The skid 15 also includes a radial finger 17 directed towards the inside of the sheath, either by passing through a slot 18 formed through the wall of the sheath, or else by going past the edge of the curtain if it does not extend beyond the end of the bar. The skid is placed on that side of the curtain which is usually pressed against the corresponding side of the slideway by the wind or by a pressure difference. The skid may be made of plastic, rubber, wood, etc., and is preferably not made of metal since it rubs against metal and avoiding metal avoids wear, scratching, and noise. It is also possible to place skids on both sides should that be necessary. A slot may be formed through each side. The fingers 17 either lie side-by-side or one on the other depending on the shapes they are given, or else one of the fingers may be omitted. The skid also holds the bar in position to prevent it rubbing against the web of the slideway. The corresponding force is very limited since, in theory, the bar does not receive any longitudinal thrust.

In an advantageous embodiment of the invention, the outside face of the skid is provided with ribs 19 or with other analogous projections perpendicular to the axis of the bar, i.e. vertical ribs extending in the direction of the edges of the slideways. These ribs co-operate with the edges 13 and 14 of the slideways during up and down movements of the curtain to impede possible dislocation of the curtain, e.g. under the effect of an oblique wind, a swirling gust, etc. In general, according to an advantageous characteristic of the invention, the edge 13 of the slideway against which the skid bears and slides is provided with a folded-back portion facilitating motion in the vertical direction and impeding motion in a horizontal direction.

The invention naturally applies to other curtain doors, such as wind-up doors. In such doors, it is the curtain itself that is wound onto a shaft.

In an advantageous embodiment of the door of the invention, the edge of the curtain is flexible and extends beyond the end of the bar and may therefore rub without hindrance against the web of the slideway, thereby providing sealing between the two sides of the door.

I claim:

1. A raisable-curtain industrial door, comprising: two lateral slideways (1,2) disposed on opposite sides of a door opening, and a raisable curtain (4) which includes continuous lateral edges that slide in the slideways, said curtain being reinforced by horizontal reinforcing bars (5) having ends that slide in the slideways, the reinforcing bars being disposed in sheaths (6) formed by localized double thicknesses of the curtain, the sheaths having slots (18) close to the lateral edges of the curtain, wherein the door includes a plurality of skids (15) which each comprise a portion that is semi-cylindrical in shape with fixing means (16) for fixing it to the curtain, and which carry at an end a radial finger (17), wherein each skid has said semi-cylindrical portion fixed to said curtain by said fixing means at a location corresponding to a first end of one of said bars, said finger of said skid being engaged towards the inside of one of said sheaths which contains said bar, through one of said slots, said first end of said bar being abutted against said finger, said semi-cylindrical portion extending along said sheath and said bar towards a second end of said bar, wherein said skids slide in contact with the slideways, wherein each continuous lateral edge of the curtain is extended beyond the ends of the reinforcing bars, each of the slideways includes a web (10) substantially perpendicular to the curtain, and each continuous lateral edge of the curtain extends towards the inside of a slideway until it comes into contact with the web thereof to establish and maintain a continuous seal.

2. An industrial door according to claim 1, in which the semi-cylindrical portion of each skid is provided with a plurality of horizontally spaced, vertical outside ribs (19), each slideway including at least one edge against which the skids press and slide, and said edge is formed by a plate that is not parallel to the curtain and that co-operates with the ribs so as to facilitate movement of said curtain in a vertical direction and so as to make movement of the curtain difficult in a horizontal direction.

3. An industrial door according to claim 1, wherein said raisable curtain folds concertina-like when raised.

* * * * *